US007900359B2

(12) United States Patent
Royle

(10) Patent No.: US 7,900,359 B2
(45) Date of Patent: Mar. 8, 2011

(54) HAIR TRIMMER

(75) Inventor: Terence Gordon Royle, Hampshire (GB)

(73) Assignee: The Gillette Company, Boston, MA (US)

( * ) Notice: Subject to any disclaimer, the term of this patent is extended or adjusted under 35 U.S.C. 154(b) by 427 days.

(21) Appl. No.: 11/897,839

(22) Filed: Aug. 31, 2007

(65) Prior Publication Data

US 2009/0056148 A1 Mar. 5, 2009

(51) Int. Cl.
*B26B 19/02* (2006.01)

(52) U.S. Cl. ..... 30/34.1; 30/43.92

(58) Field of Classification Search ..... 30/34.05, 30/34.1, 43, 122, 12.3, 29.5, 43.92, 210, 30/216, 197, 123
See application file for complete search history.

(56) References Cited

U.S. PATENT DOCUMENTS

| | | | | |
|---|---|---|---|---|
| 458,940 | A | 9/1891 | Bonham | |
| 1,380,272 | A * | 5/1921 | Tomasulo | 30/197 |
| 1,519,601 | A * | 12/1924 | Tomasulo | 30/197 |
| 2,484,610 | A * | 10/1949 | Cromonic | 30/210 |
| 4,262,415 | A * | 4/1981 | Braun | 30/34.1 |
| 4,521,962 | A * | 6/1985 | Van Natta | 30/34.1 |
| 5,325,590 | A * | 7/1994 | Andis et al. | 30/216 |
| 6,000,135 | A * | 12/1999 | Ullmann et al. | 30/43.92 |
| 6,502,312 | B2 * | 1/2003 | Beutel et al. | 30/216 |
| 6,604,287 | B2 * | 8/2003 | Melton et al. | 30/123 |
| 6,684,507 | B2 * | 2/2004 | Lau et al. | 30/34.1 |
| 6,684,511 | B2 * | 2/2004 | McCambridge et al. | 30/216 |
| 6,928,738 | B2 * | 8/2005 | Segrea | 30/34.1 |
| 7,188,422 | B2 * | 3/2007 | McCambridge et al. | 30/122 |
| 7,484,982 | B1 * | 2/2009 | Royle | 439/311 |
| 7,503,117 | B2 * | 3/2009 | Wetzel et al. | 30/34.1 |
| 7,721,451 | B2 * | 5/2010 | Psimadas et al. | 30/34.1 |
| 7,761,998 | B2 * | 7/2010 | Blaustein et al. | 30/34.05 |
| 2003/0106219 | A1 * | 6/2003 | Lau | 30/43 |
| 2003/0126744 | A1 | 7/2003 | Lau et al. | |
| 2005/0217115 | A1 | 10/2005 | Blaustein et al. | |
| 2006/0168816 | A1 | 8/2006 | Wetzell et al. | |
| 2007/0180699 | A1 * | 8/2007 | Psimadas et al. | 30/34.1 |
| 2007/0220752 | A1 * | 9/2007 | Psimadas et al. | 30/34.05 |
| 2009/0056137 | A1 * | 3/2009 | Royle | 30/34.1 |
| 2009/0056139 | A1 * | 3/2009 | Royle | 30/34.05 |
| 2010/0139097 | A1 * | 6/2010 | Perez-Lopez et al. | 30/34.1 |

FOREIGN PATENT DOCUMENTS

| | | |
|---|---|---|
| WO | WO 00/37225 | 6/2000 |
| WO | WO 2005/077613 | 8/2005 |

OTHER PUBLICATIONS

PCT International Search Report and Written Opinion dated Jan. 21, 2009 (13 pgs).
www.braun.com/na/cruzer/cruzer.html—Braun Cruzer product website. Product description (23 pgs).

* cited by examiner

*Primary Examiner* — Jason Daniel Prone
(74) *Attorney, Agent, or Firm* — Ronald T. Sia; Kevin C. Johnson; Steven W. Miller

(57) ABSTRACT

A hair trimming device is detachably mounted on a handle housing a battery for supplying electric current to a motor located in a drive unit of the trimming device. A trimmer unit includes a plurality of trimmer blade assemblies with different configurations and is rotatable on the drive unit for moving a selected one of the blade assemblies to the operative position in which it is coupled to be driven by the drive unit whilst the other blade assembly which is not in the operative position is uncoupled from the drive output of the drive unit.

14 Claims, 4 Drawing Sheets

HAIR TRIMMER

FIELD OF THE INVENTION

This invention relates to hand-held personal care appliances, and is concerned in particular with a hair trimming device.

BACKGROUND OF THE INVENTION

It is well known for electric dry razors to be equipped with long hair trimming devices for trimming and shaping hair in areas where longer hair is allowed to grow, such as sideburns or moustaches, as well as shaving foils or other forms of cutter for use in areas where it is desired to shave very closely to the skin surface. Usually the trimming device is selectively actuable and it may be movably mounted to the dry razor for adjustment between operative and inoperative positions. In one well known example, a razor with a handle on which a safety razor cartridge is mounted for use as a conventional wet razor, and the handle also includes an electrically driven hair trimmer which can be either fixed in position or movable between a stowed position and a position suitable for use. A common drawback of these known razors is that due to their dual purpose and the trimming devices being of secondary importance in comparison with the main use of the razors for shaving, the trimming devices are not as a rule optionally positioned in relation to the razor handle to facilitate most effective and convenient use. In addition, a single trimmer configuration, which is most commonly relatively long and straight, is not ideal for all hair trimming and shaping needs and demands.

A battery operated electric razor currently marketed by Braun GmbH, and sold under the trade mark cruZer, is provided with a trimming unit that is mounted on the main casing of the razor for movement from an inoperative position to an operative position. The trimmer unit is provided with two blade assemblies positioned opposite one another with respect to an axis about which the trimmer unit is rotatable for selecting the blade assembly that is to be used. One blade assembly is long and straight and the other is relatively short and curved. When the trimmer unit is switched on both blade assemblies are driven although only one can occupy the operative position in which it is usable for trimming and shaping hair. Thus, the battery power consumed in driving the inoperatively positioned blade assembly is wasted.

SUMMARY OF THE INVENTION

The present invention addresses the drawbacks of the known trimming devices as explained above and provided in accordance with the invention is a hair trimming device comprising: a drive unit providing a drive output; a trimmer unit including a plurality of blade assemblies, the trimmer unit being movably mounted to the drive unit for bringing a selected one of the blade assemblies into an operative position; a coupling arrangement for coupling the blade assemblies to the drive output whereby the selected blade assembly in the operative position is coupled to be driven by the drive output and the or each other blade assembly is uncoupled from the drive output.

With a hair trimming device embodying the invention only that blade assembly in an operative hair trimming position is driven so that battery power will be consumed more efficiently. Nonetheless different blade assembly configurations are available for easy selection according to the needs and preferences of the user. In a preferred construction the trimmer unit is rotatable relative to the drive unit, which is especially convenient for changing the selected blade assembly in the operative position. In addition the trimmer unit can be translatable relative to the drive unit to displace a blade assembly away from the operative position and to uncouple the blade assembly from the drive output of the drive unit. In a particular construction the trimming unit is rotatably connected to a mounting plate, and the mounting plate is connected to the drive unit for translatory movement.

The drive unit can be mounted firmly on a handle of a hand held hair trimming appliance. In a preferred embodiment the trimming device is detachably connected to a handle which includes a battery compartment for accommodating a battery to supply electric current for driving a motor housed to the drive unit. The detachable handle can then be disconnected from the hair trimming device to facilitate recharging a rechargeable battery housed in the handle and/or for use with other forms of operating head, such as to form a vibrating safety razor by assembly with a separate safety razor operating head.

The drive output of the drive unit may comprise a reciprocally driven output member, and the drive unit conveniently includes a rotary motor and a transmission mechanism to convert rotation of a motor shaft into reciprocation of the drive output member. The transmission mechanism may comprise an eccentric connected to the motor shaft and engaged with a bridge member that is carried by a pair of parallel pivotal links whereby the bridge member is reciprocated in response to rotation of the motor shaft.

In an especially convenient embodiment each blade assembly includes a blade driving element, and the coupling arrangement comprises a slot defined in each blade driving element for cooperation with the drive output member. Furthermore, each slot includes a driving section and a mouth section which converges towards the driving section for guiding the drive output member into the driving section when the blade assembly is moved to the operative position. A simple construction is achieved with at least one and preferably each blade assembly comprising a first trimmer blade fixed with respect to the trimmer unit and a second blade guided for reciprocation relative to the first trimmer blade and connected to the blade driving element.

The foregoing and other features and advantages of the invention will be more fully understood from the following detailed description of a preferred embodiment.

DETAILED DESCRIPTION OF THE INVENTION

Figure 3:
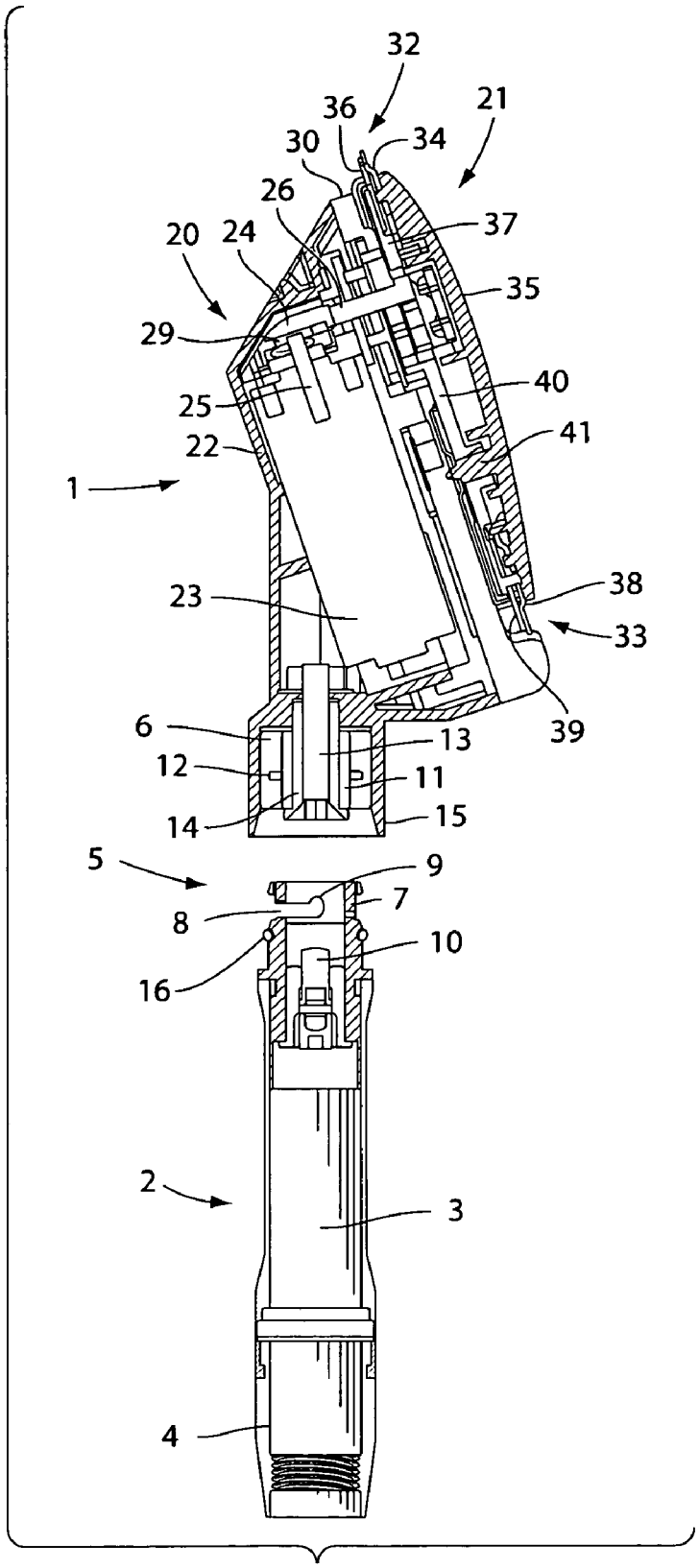
FIG. 3 is a cross-section through the trimming device of FIGS. 1 and 2 along with a handle to which the trimming device is detachably connectable.
Figure 4:
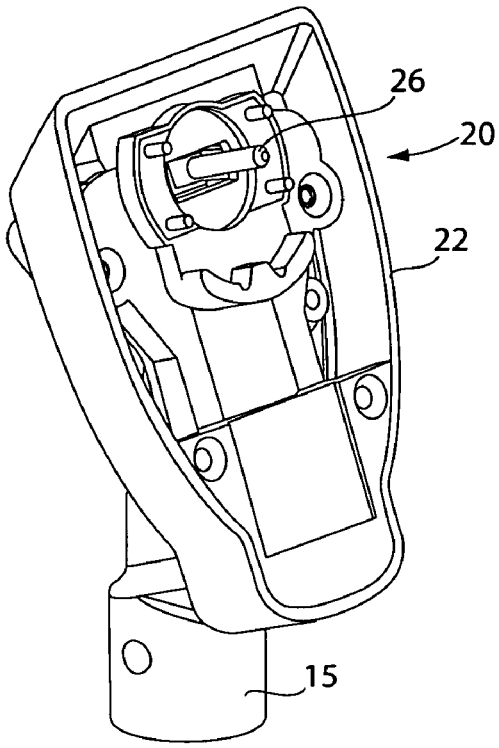
FIG. 4 is a front perspective view showing the drive unit of the trimming device of FIGS. 1 to 3.
Figure 5:
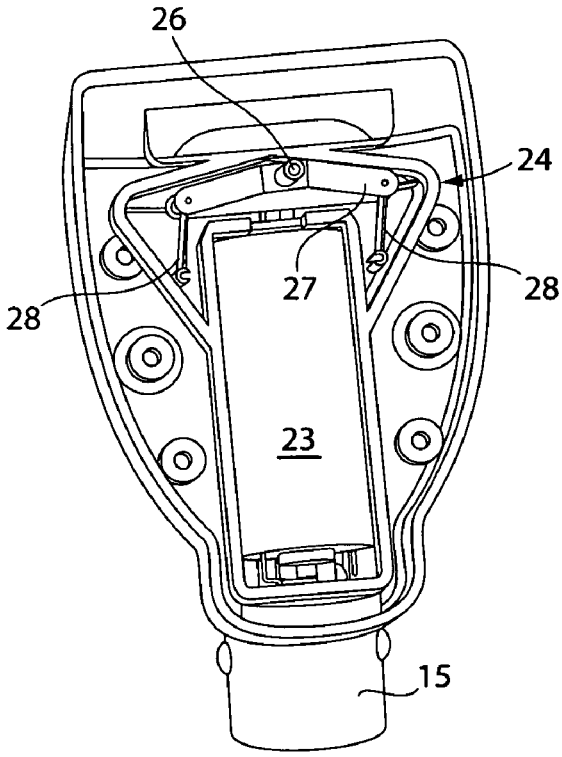
FIG. 5 is a front elevational view showing the interior of the drive unit.

Illustrated in the drawings is a hand held personal grooming appliance comprising a hair trimming device 1 and a handle 2 to which the trimming device is adapted to be detachably connected (FIG. 3). The handle 2 includes a battery compartment in which a rechargeable battery 3 is accommodated, a switch arrangement 4 for controlling supply of electric current from the battery 3 to the trimming device when mounted to the handle. A coupling is provided for electrically and mechanically connecting the handle to the trimming device, the coupling comprising a female coupling member 5 on the handle 2 and a male coupling member 6 on the trimming device 1. The female coupling member 5 includes a sleeve portion 7 located at the upper end of the handle and provided with a pair of symmetrical bayonet slots 8 with locking recesses 9 at their ends. Positioned centrally within the sleeve portion 7 is a first electrical contact 10 which is spring-loaded and urged axially towards the upper end of the handle. The male coupling member 6 has a plug 11 adapted to mate with the female coupling member by sliding engagement in the sleeve portion 7, and the plug part has a pair of diametrically opposed pin projections 12 arranged for cooperation with the respective bayonet slots 8. A second electrical contact 13 is located centrally within the plug part 11 with an electrical insulator 14 being disposed therebetween. When the male and female coupling members 5, 6 are fully engaged the first and second contacts 10, 13 are pressed into close abutment due to the spring loading of the first contact, and this spring loading also serves to urge the pin projections 12 into the locking recesses 9 of the bayonet slots 8 to secure the trimming device 1 against unintentional disconnection from the handle 2. The sleeve portion 7 and the plug part 11 form further electric contacts that cooperate to complete a circuit for the flow of electrical current between the battery in the handle and the trimming device. The trimming device 1 includes a hood or shroud 15 which surrounds the plug part 11 for enclosing the male and female members of the bayonet coupling to preclude ingress of moisture to the electrical contacts. The female member carries an annular seal 16, such as an O-ring seal, disposed in a peripheral groove provided on the sleeve portion 7 axially inwardly of the bayonet slots 8, and the shroud 15 has a close fit over the seal 16 to ensure a watertight connection between the shroud and the handle when the male and female coupling members are engaged.

Figure 6:
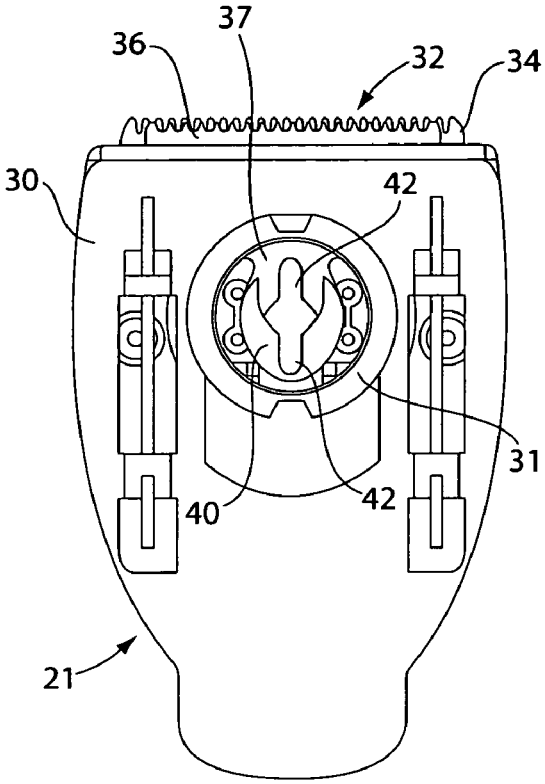
FIG. 6 is a rear elevation of the trimmer unit of the trimming device as shown in FIG. 1 with the first blade assembly in the operative position.
Figure 7:
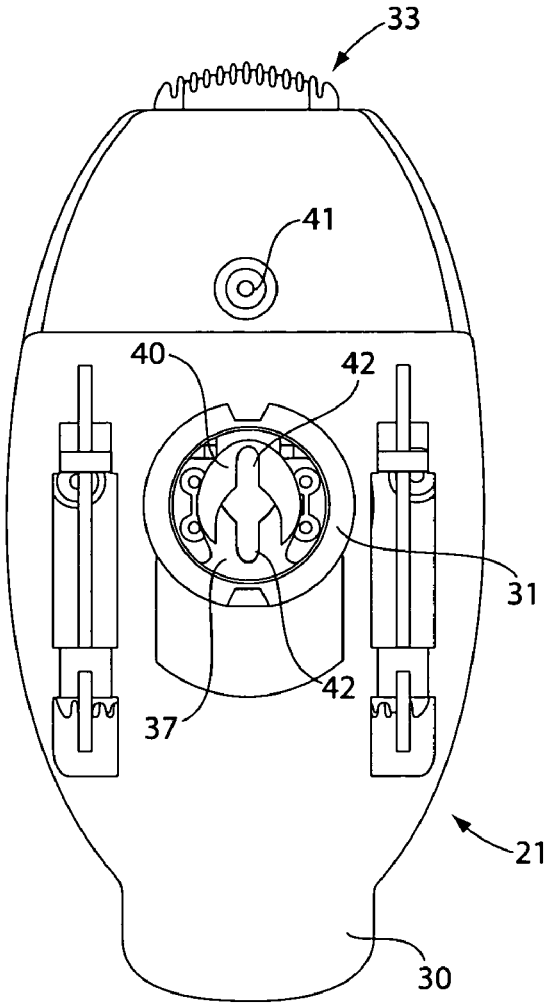
FIG. 7 is a rear elevation of the trimmer unit of the trimming device as shown in FIG. 2 with the second blade assembly in the operative position.
Figure 8:
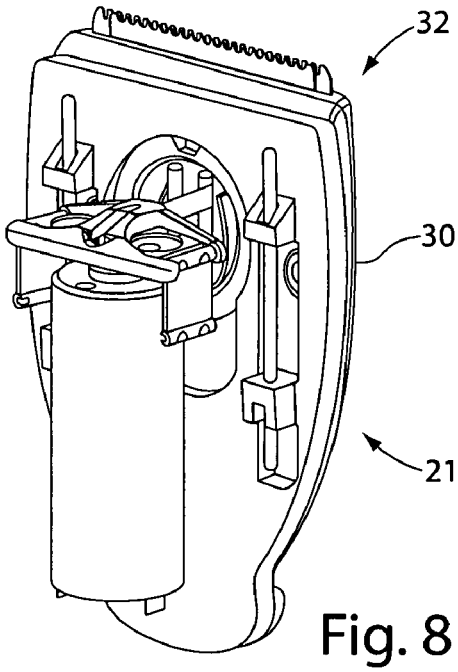
FIG. 8 is a perspective illustration showing the motor and transmission of the drive unit in assembly with the trimmer unit.

The trimming device includes a drive unit 20 and a trimmer unit 21. The male coupling member 6 and the shroud 15 are provided on a housing 22 of the drive unit in which is housed an electric rotary motor 23 and a transmission mechanism 24 for converting rotary motion of a motor shaft 25 into reciprocation of a drive output member 26 in the form of a drive pin. The electric terminals of the motor are connected to the electrical contacts 11 and 13 of the trimming device for supply of current from the battery 3 in the handle for driving the motor. The transmission mechanism includes a bridge member 27 carried on a pair of pivotal links 28 pivoted to the housing 22 so that the bridge member is capable of reciprocating in the housing of the drive unit, an eccentric 29 connected to the motor shaft 25 being engaged with the bridge member to cause it to reciprocate when the motor shaft is driven by the motor. The drive output pin 26 is firmly fixed to the bridge member 27 and protrudes forwardly from the drive unit 20 into the trimmer unit 21. Connected to the front of the drive unit is a mounting plate 30 for the trimmer unit 21, the mounting plate being guided for up and down translatory movement relative to the drive unit for purposes which will become clear. The trimmer unit is held to the mounting plate 30 by a flanged circular collar 31 which is engaged in corresponding shaped hole in the mounting plate so that the trimmer unit 21 is able to rotate relative to the mounting plate 30 and hence also the drive unit 20. The trimmer unit includes a first trimmer blade assembly 32 and a second trimmer blade assembly 33. The first blade assembly 32 is comparatively long and straight and includes a first trimmer blade 34 fixedly mounted to a face plate 35 of the trimmer unit, and a second trimmer blade 36 guided for reciprocation relative to the first trimmer blade and attached to a blade driving element 37. The second blade assembly 33 is relatively short with a convex profile and includes a first trimmer blade 38 fixedly mounted to the face plate 35 and a second trimmer blade 39 guided for reciprocation along a curved path relative to the first trimmer blade 38 and attached to a blade driving element 40 which is mounted to the face plate 35 by a pivot 41. Each of the blade driving elements 37, 40 includes a slot 42 with a narrow driving section in which the drive output pin 26 is engageable for reciprocating the blade driving element and also reciprocating the trimmer blade attached to the blade driving element, and a mouth section which converges towards the driving section for guiding the drive output pin 26 into the driving section. As best seen in FIGS. 6 and 7, the slots 42 are aligned but face in opposite directions with the mouth sections overlapping.

Figure 1:
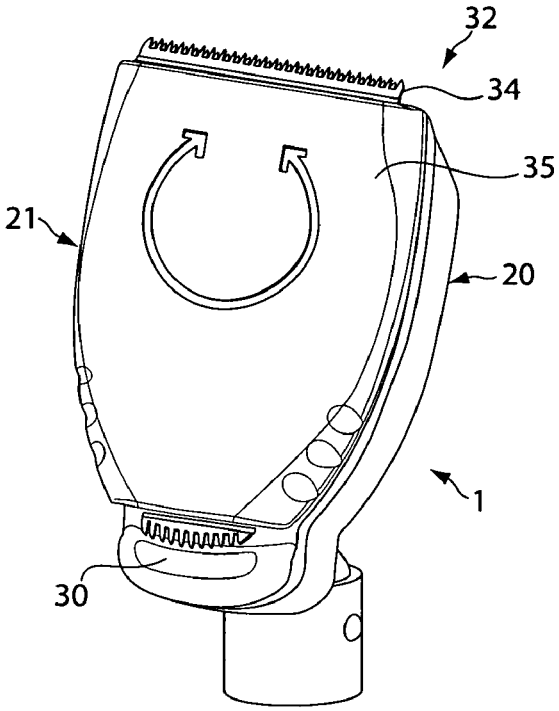
FIG. 1 is a front perspective view showing a trimming device in accordance with the invention adjusted with a first trimming blade assembly in an operative position.
Figure 2:
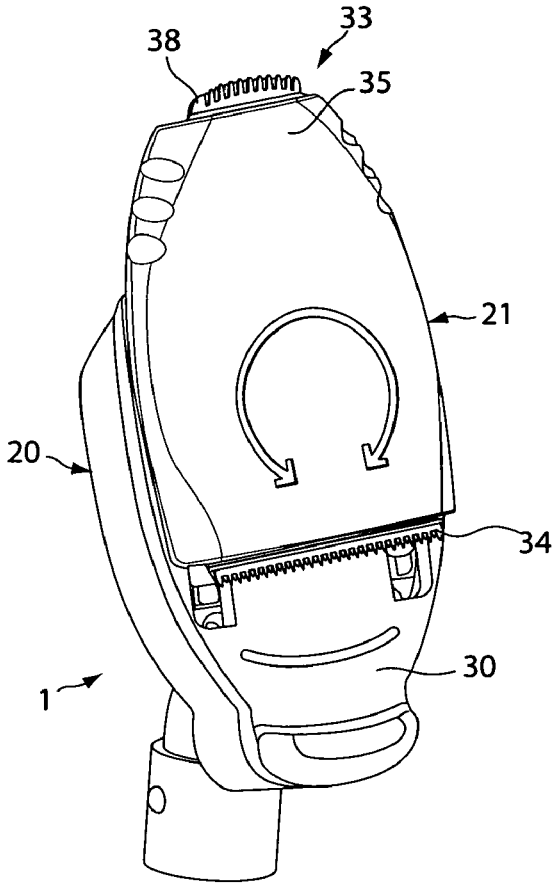
FIG. 2 is a front perspective view showing the trimming device of FIG. 1 adjusted with a second trimming blade assembly adjusted to the operative position.

When the mounting plate 30 is displaced upwardly relative to the drive unit the drive output pin 26 projects into the trimmer unit 21 along the axis of the collar 31 and passes through the mouth sections of the slots 42 in the blade driving elements 37, 40. In this position of the mounting plate the trimmer unit 21 can be rotated about the axis of the collar 31 relative to the mounting blade to selectively adjust either the first blade assembly 32 or the second blade assembly 32 to the operative position as respectively illustrated in FIGS. 1 and 2 and in FIGS. 6 and 7. Downward displacement of the mounting plate 30 and the trimmer unit then causes the drive output pin 26 to be guided into and to operatively engage in the driving section of the slot 42 in the blade driving element 37 or 40 of the trimmer blade assembly 32 or 33 disposed in the operative position. Actuation of the motor 23 then puts the selected trimmer blade assembly into operation whilst the other trimmer blade assembly remains uncoupled from the drive output pin 26 and will remain inactive with the result that battery power is not wasted in unnecessarily driving the blade assembly which is not in the operative position.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not be construed as an admission that it is prior art with respect to the present invention. To the extent that any meaning or definition of a term in this written document conflicts with any meaning of definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hair trimming device comprising:

a drive unit providing a drive output;

a trimmer unit comprising a first blade assembly and a second blade assembly, the trimmer unit being movably mounted to the drive unit for bringing at least one of said first blade assembly and said second blade assembly into an operative position;

a coupling arrangement for coupling one of said first blade assembly and said second blade assembly to the drive output at a time, wherein the drive unit comprises a rotary motor, and a transmission mechanism to convert rotation of a motor shaft into reciprocation of the drive output member, and wherein the transmission mechanism comprises an eccentric connected to the motor shaft and engaged with a bridge member, the bridge member being carried by a pair of parallel pivotal links whereby the bridge member is reciprocated in response to rotation of the motor shaft.

2. The hair trimming device of claim 1, wherein the trimmer unit is rotatable relative to the drive unit thereby allowing the trimmer unit to rotate relative to the drive unit for changing a selected one of said first and second blade assemblies to the operative position.

3. The hair trimming device of claim 2, wherein the-mounting plate is connected to the drive unit allowing for up and down translatory movement of the mounting plate and the trimming unit relative to the drive unit thereby displacing the trimmer unit away from the operative position and to uncouple said mounting plate and the trimming unit from the drive output.

4. The hair trimming device of claim 1, wherein the drive output comprises a reciprocably driven drive output member.

5. The hair trimming device of claim 1, wherein each of said first blade assembly and said second blade assembly includes a blade driving element, and the coupling arrangement comprises a slot defined in each blade driving element for coupling said first blade assembly or second blade assembly with the drive output member.

6. The hair trimming device of claim 5, wherein the slot defined in the blade driving element of each blade assembly includes a driving section, and a mouth section for guiding the drive output member into the driving section when the blade assembly is moved into the operative position.

7. The hair trimming device of claim 5, wherein each of said first blade assembly and said second blade assembly comprises a first trimmer blade fixed with respect to the trimmer unit and a second trimmer blade guided for reciprocation relative to the first trimmer blade and connected to the blade driving element.

8. The hair trimming device of claim 1, wherein the drive unit is detachably connected to a handle, and the handle includes a battery compartment for accommodating a battery to supply electric current for driving a motor housed in the drive unit.

9. A hair trimming device comprising:

a drive unit providing a drive output;

a trimmer unit comprising a first blade assembly and a second blade assembly, the trimmer unit being movably mounted to the drive unit for bringing at least one of said first blade assembly and said second blade assembly into an operative position;

a coupling arrangement for coupling one of said first blade assembly and said second blade assembly to the drive output at a time, wherein the trimmer unit is rotatable relative to the drive unit thereby allowing the trimmer unit to rotate relative to the drive unit for changing a selected one of said first and second blade assemblies to the operative position, wherein the mounting plate is connected to the drive unit allowing for up and down translatory movement of the mounting plate and the trimming unit relative to the drive unit thereby displacing the trimmer unit away from the operative position and to uncouple said mounting plate and the trimming unit from the drive output, wherein the drive unit comprises a rotary motor, and a transmission mechanism to convert rotation of a motor shaft into reciprocation of the drive output member, and wherein the transmission mechanism comprises an eccentric connected to the motor shaft and engaged with a bridge member, the bridge member being carried by a pair of parallel pivotal links whereby the bridge member is reciprocated in response to rotation of the motor shaft.

10. The hair trimming device of claim 9, wherein the drive output comprises a reciprocably driven drive output member.

11. The hair trimming device of claim 9, wherein each of said first blade assembly and said second blade assembly includes a blade driving element, and the coupling arrangement comprises a slot defined in each blade driving element for coupling said first blade assembly or second blade assembly with the drive output member.

12. The hair trimming device of claim 11, wherein the slot defined in the blade driving element of each blade assembly includes a driving section, and a mouth section for guiding the drive output member into the driving section when the blade assembly is moved into the operative position.

13. The hair trimming device of claim 11, wherein each of said first blade assembly and said second blade assembly comprises a first trimmer blade fixed with respect to the trimmer unit and a second trimmer blade guided for reciprocation relative to the first trimmer blade and connected to the blade driving element.

14. The hair trimming device of claim 9, wherein the drive unit is detachably connected to a handle, and the handle includes a battery compartment for accommodating a battery to supply electric current for driving a motor housed in the drive unit.

* * * * *